United States Patent [19]

Hill

[11] 4,061,087

[45] Dec. 6, 1977

[54] PLATE LOCKING STRUCTURE FOR PRESS CYLINDERS

[75] Inventor: George B. Hill, Salt Lake City, Utah

[73] Assignee: Newspaper Equipment Company, Salt Lake City, Utah

[21] Appl. No.: 751,276

[22] Filed: Dec. 17, 1976

[51] Int. Cl.[2] ..... B41F 27/06

[52] U.S. Cl. ..... 101/415.1

[58] Field of Search ..... 101/415.1, 407, 378

[56] References Cited

U.S. PATENT DOCUMENTS

| | | | |
|---|---|---|---|
| 2,133,252 | 10/1938 | Moore et al. | 403/331 |
| 2,229,059 | 1/1941 | Ditly et al. | 101/415.1 |
| 3,103,169 | 9/1963 | Taylor | 101/415.1 |
| 3,237,558 | 3/1966 | Fagg, Jr. | 101/415.1 |
| 3,332,346 | 7/1967 | Luehrs | 101/415.1 |
| 3,696,744 | 10/1972 | Etchell | 101/415.1 |
| 3,750,572 | 8/1973 | Etchell et al. | 101/415.1 |
| 3,896,727 | 7/1975 | Ruckdeschel, Jr. | 101/415.1 |
| 3,994,224 | 11/1976 | Hill | 101/415.1 |

*Primary Examiner*—Edgar S. Burr
*Assistant Examiner*—William Pieprz

[57] ABSTRACT

Apparatus for printing press cylinders for releasably retaining printing plates. A printing plate locking bar is utilized in conjunction with a base member, the base member being fixed to a press cylinder construction and a locking bar being slidably secured thereto, thus adapted for sliding in a direction transverse to the longitudinal axis of the locking bar. Latching means is provided for releasably latching the locking bar in a particular position for printing plate removal and replacement. Spring means are supplied to spring-tension the printing plate so mounted, once the latching means is unlatched. Additional latching means may be provided for enabling the positive securement of the locking bar relative to such base member, through additional latch structure, where the plate is to be positively locked in its intended taut condition.

13 Claims, 17 Drawing Figures

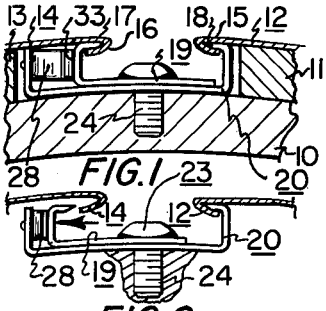
FIG. 1
FIG. 2
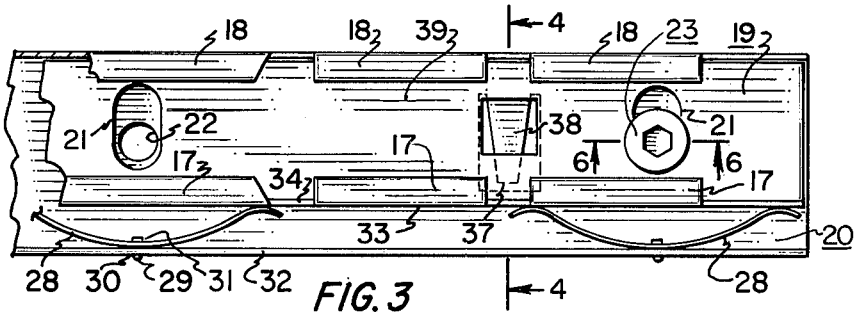
FIG. 3
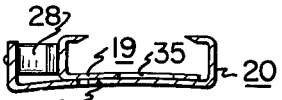
FIG. 4
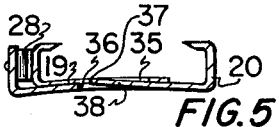
FIG. 5
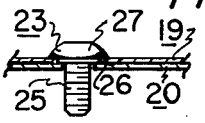
FIG. 6
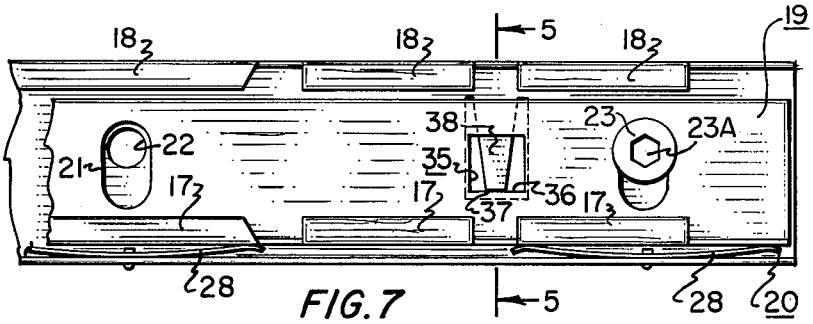
FIG. 7
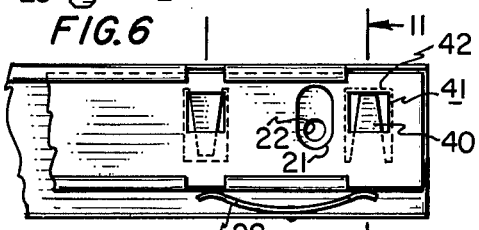
FIG. 8
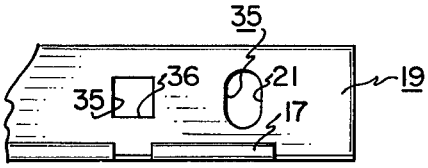
FIG. 9
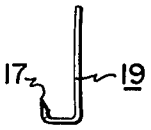
FIG. 10
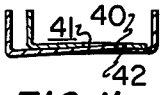
FIG. 11
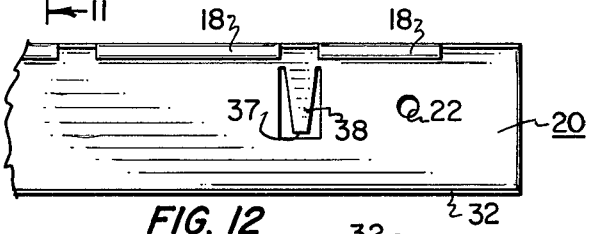
FIG. 12
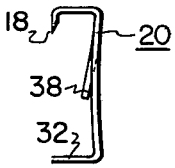
FIG. 13
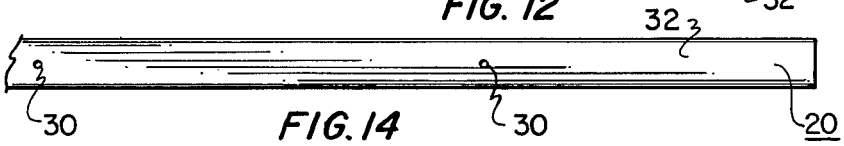
FIG. 14
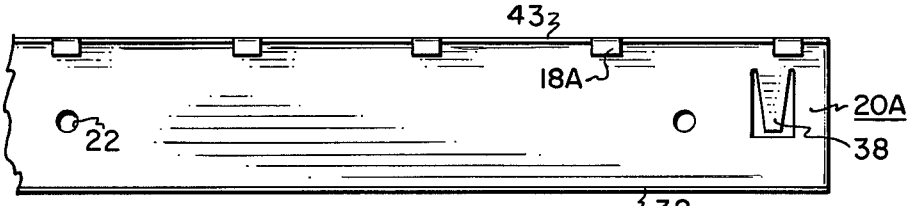
FIG. 15
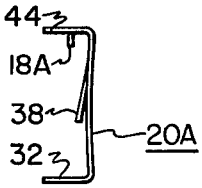
FIG. 16
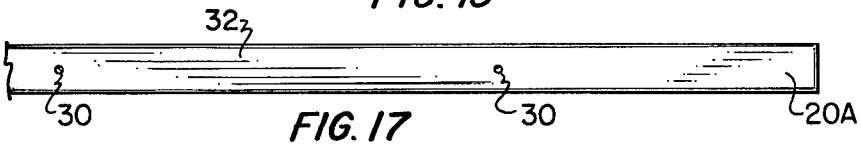
FIG. 17

PLATE LOCKING STRUCTURE FOR PRESS CYLINDERS

FIELD OF THE INVENTION

The present invention relates to printing press cylinders and, more particularly, provides printing plate latching means for tautly securing and also releasing printing plates of various designs with respect to the usual saddles carried by such cylinders.

DESCRIPTION OF PRIOR ART

Heretofore, many types of apparatus have been utilized with press cylinders and press saddles for achieving a releasable lock-up as between a replaceable printing plate and the cylinder structure. Certain United States patents bear upon various structural features of plate lock-up as follows:

U.S. Pat. Nos. 3,697,744; 3,791,295; 2,386,214; 2,387,332; 2,621,592; 3,017,830; 3,903,796; 3,533,355; 3,766,857; 3,858,511; 3,874,292; 3,896,728 and 3,994,224.

The inventor's prior patent No. 3,994,224 teaches a detent mechanism which is receivable actually in the cylinder structure and is selectively operable.

All of the prior structures do have some expense involved as to fabrication. The present invention relates to inexpensive lock-up mechanism which is far less expensive than former structures and yet operates in a highly satisfactory manner.

BRIEF SUMMARY OF THE INVENTION

According to the present invention elongate base member, and locking bar slidingly received thereby, are constructed for securement to a press cylinder structure. The base member is provided with locking finger means that are normally upwardly angulated or canted to selectively lock against the edge of suitably designed apertures provided in the locking bar. Such fingers are selectively depressable by conventional tool means, for example, so that the locking bar can be slid back and forth over the finger means with the rest of the upper surface of the base member. The locking bar is spring-tensioned to supply a tensioning or tautness pressure as to the printing plate mounted to the locking bar. The latching means releasably latches the locking bar in a plate-unlock position for accomplishing plate removal. Unlatching permits the spring means employed to operate so as to resume a tensioning pressure to a newly installed plate engaging such locking bar. Additional locking means are provided to assure a positive lock of the disposition of the locking bar relative to its base member when a desired tensioning position by the locking bar is achieved.

OBJECTS

Accordingly, a principal object of the present invention is to provide new and improved press structure improvements for printing establishments.

A further object is to provide, for and with a press cylinder, improved and inexpensive locking means to effect the tensioning of printing plates over printing cylinders.

A further object is to provide elongate structure, conventionally attachable to a press cylinder or associated structure which will enable the selective locking and release of printing plates.

A further object is to provide improved latching means for printing plate lock-up mechanisms in press cylinders.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

BRIEF DESCRIPTION OF THE DRAWINGS

FIG. 1 is a fragmentary side elevation, principally in section, of the locking structure used in a preferred embodiment of the present invention.

FIG. 2 is similar to FIG. 1 but illustrates the locking bar of the locking structure having been advanced laterally to effect printing plate release.

FIG. 3 is a fragmentary plan view of the locking structure of FIG. 1 and is rotated 90° counter-clockwise.

FIG. 4 is a transverse vertical section taken along the line 4—4 in FIG. 3, illustrating that the latching finger is pressed flat when the locking bar is disposed over the base member of the locking structure in the condition wherein the printing plate anchored to the locking bar is in a taut condition.

FIG. 5 is similar to FIG. 4 but illustrates, as in the case of FIG. 2, that when the locking bar is laterally advanced so as to effect a plate release, the latching finger raises naturally at its end, by virtue of its spring temper, so that the latch finger end engages a reaction edge of a suitable aperture disposed in said locking bar.

FIG. 6 is a longitudinal, vertical section, taken along the lines 6—6 in FIG. 3, illustrating the configuration of a representative shoulder bolt and its operation with the cylinder, base member, and locking bar.

FIG. 7 illustrates the structure of FIG. 3 wherein the locking bar has been advanced downwardly, relative to the viewer, so that the finger springs upwardly and engages an edge of an associated locking bar aperture; FIG. 7 illustrates one of several latching fingers and shoulder bolts which may be employed in the structure.

FIG. 8 is a fragmentary view of the structure of FIG. 7 wherein an additional latch means is provided for achieving a positive lock at that position of the locking bar wherein the printing plate secured to such locking bar has become fully taut and is tended to remain in such condition.

FIG. 9 is a fragmentary plan view of the right end of the locking bar of FIGS. 1 and 7; both ends of the base member will be typical.

FIG. 10 is an end view of the structure of FIG. 9.

FIG. 11 is a transverse vertical section taken along the line 11—11 of FIG. 8, illustrating the latched condition of a locking bar relative to its base member when the locking bar has advanced sufficiently under pressure so as to render the printing plate taut and in condition for the positive lock of such new latching member supplied.

FIG. 12 is a fragmentary plan view of the base member of FIGS. 1 and 7; both ends thereof are typical.

FIG. 13 is an end view of the base structure of FIG. 12.

FIG. 14 is a front elevation of the base member of FIG. 12.

FIG. 15 is a fragmentary plan of an alternate base member employed in connection with the securement of metal-backed plates, the tabs indicated taking the place of the usual pins.

FIG. 16 is an end view of the base member of FIG. 15.

FIG. 17 is a front view of the base member of FIG. 15.

DESCRIPTION OF PREFERRED EMBODIMENTS

In FIGS. 1–7 a conventional, revolving press cylinder 10, standard in newspaper presses, will be provided with the usual saddle 11 over which a printing plate 12 will be secured. An additional saddle 13, likewise conventionally disposed and secured on a cylinder, will back the under-surface of printing plate 14. Printing plates 12 and 14 are conventionally formed and have double-back margins 15 and 16 which register with tongue portions 17 and 18 of the locking bar 19 and base member 20, respectively, of this invention.

Locking bar 19 includes a series of guide slot apertures 21 which register with mounting apertures 22 of base member 20. A series of aligned shoulder bolts 23, one being shown, are disposed in apertures 21 and 22 and threaded into threaded apertures 24 of cylinder 10. The shoulder bolts 23 include threaded shanks 25, shoulders 26 and heads 27, the latter preferably designed for Allan wrench actuation at recesses 23A, see FIG. 7. The shoulder 26 engages the straight sides of apertures 21, see also FIGS. 9, 10, to provide for a rectilinear transverse movement of the locking bar 19 relative to base member 20, shown also in FIGS. 12–14. Leaf springs 28 are secured as shown by rivets 29, passing through apertures 30 and 31 of upstanding flange 32 of base member 20 and the respective leaf springs 28. These leaf springs thus engage the surface 33 of upstanding flange 34 of locking bar 19. Of special importance is the inclusion of aperture 35, the same having a reaction edge 36. The latter is selectively cooperable with end 37 of resilient, canted or normally inclined latch finger 38.

Apertures 35 are preferably medially disposed such that end 37 is covered, i.e. is overlapped and pressed downwardly, by the base portion 39 of locking bar 19 when the structure is in the position shown in FIG. 1; in FIG. 1 there is indicated a secure engagement of tongue portion 17 with printing plate 13, see FIGS. 1 and 4. FIG. 1, of course, shows opposite ends of end-adjacent printing plates, the remaining end being like mounted by like structure of FIGS. 1–7.

When the locking bar 19 is to be urged in the position shown in FIGS. 2 and 5 against the spring-pressure of leaf springs 28, then the resilient, canted latch fingers 38 of base member 20 will spring upwardly to their nominal position such that the ends 37 will engage the reaction edges 36 of apertures 35. This condition is shown in FIGS. 2 and 4 and may be produced when a person urges, as by a screwdriver, the locking bar 19 in the direction shown by the arrow in FIG. 2, so as to release printing plate 14 from engagement with tongue portion 17.

A return of the locking bar 19 to its condition shown in FIG. 3 is accomplished simply by the user pressing down on the several fingers 38 so as to release the engagement between finger end 37 and reaction edge surface 36, thereby permitting the springs 28 to push upwardly, relative to FIG. 7, the locking bar 19 so that the same now assumes the position shown in FIG. 3.

FIGS. 8 and 11 illustrate that each end of the base member 20 may be provided with an additional resilient latch finger 40, one only being shown, the same pointing in the opposite direction and cooperating with additional aperture 41 having reaction edge 42, such being disposed in locking bar 19 at each end of the same. Thus, it will be understood that the fingers 38 and 40 will be disposed at multiple points along base member 20, and be positioned for selected registry with apertures 35 and 41.

The employment of resilient, canted, spring-tempered fingers 40 will be useful to retain the locking bar in a fixed position once the spring pressure of springs 28, see FIGS. 1 and 4, have returned the locking bar 19 to its position at the right as shown in FIG. 1, wherein the printing plate is made taut by the spring 28. Thus, instead of the positioning of locking bar 19 depending upon the springs 28, particularly where a light spring pressure is used, the spring fingers 40, however many are employed, may positively lock the bar 19 relative to base member 20 in the plate-tension position shown in FIG. 1.

FIGS. 15–17 illustrate a base member 20A similar to the base member of FIGS. 12–14, but which includes contoured tabs 18A which are stamped and formed in a stamping operation relative to upstanding flange 43. Such tabs 18A or flange segments 44, as the case may be, may be employed to secure the perforated edge of a customary metal-backed printing plate, in which event similar-sized tabs may be employed at 17 in the locking bar design. Again, those artisans utilizing the invention will find the base member of FIG. 15 especially usable for conventional metal-backed plates, wherein the tabs 18A simply take the place of conventional retention pins found in other, complementary structure. The structure shown in FIGS. 3–7 is particularly useful for conventional, non-metal backed plastic plates, wherein the enlarged tongue portions retain the doubled-back end margins 16 provided in standard plastic plates.

The assembly and operation of the above structure is as follows:

The base member 20 and locking bar 19 are easily-fabricated structures, with the base member 20 being preferably made of heat-treated spring steel, for example. The base member 20 will, of course, have its fingers 38 and 40, of whatever number and position, positioned so that these are canted or angulated slightly upwardly in the direction of their outermost contact edge, as shown, but capable of being temporarily pressed down flat against the cylinder and thus be in the same plane as the base portion of the particular base member employed.

The locking bar will be disposed within the base member and the two mounted to a press cylinder which has been drilled and tapped at several locations to include the attachment bolts or other means 23. Again, these are preferably shouldered bolts. The same may be tightened down so that shoulders 26 securely retain the base portion of the base member 20 securely against the cylinder surface. The locking bar in thickness will be slightly less than the thickness of shoulder 26 of the shoulder bolts in FIG. 6 so that the locking bar is free to slide in a rectilinear fashion, transverse or normal to the longitudinal axis of the locking bar.

Spring pressure of leaf springs 28 tend to keep the structure in a condition as shown in FIGS. 1 and 3, wherein a printing plate 14 is made taut. In such a condition the fingers 38 will be pressed down and overlapped by locking bar 19.

When one chooses to release a particular printing plate, he merely urges a screwdriver having a hooked end, or other tool in the direction shown by the arrow in FIG. 2, so as to urge locking bar 19 in the direction and to the position shown in FIGS. 2 and 7. Where the latching fingers 40 are employed, these must first be depressed prior to movement of the locking bar against springs 28.

A continued advance of the locking bar in this direction produces an ultimate locking of fingers 38 relative to edges 36 of apertures 35 so that the locking bar becomes locked relative to the base member 20 and the cylinder 10, thereby permitting easy removal of printing plate 14. When such plate is replaced, then the pressure of springs 28 again come into play after one presses downwardly on the fingers 38, so as to release engagement thereof with apertures 35, thus permitting the locking bar again to slide over the ends 37 of such fingers 38, and thereby allow the locking bar to reassume its position shown in FIGS. 1 and 3.

While particular embodiments of the invention have been shown and described, it will be obvious to those skilled in the art the various changes and modifications which may be made without departing from the essential features of the present invention and, therefore, the aim in the appended claims is to cover all such changes and modifications as fall within the true spirit and scope of the invention.

I claim:

1. A structure for releasably securing an edge of a printing plate to a press cylinder over a saddle between the opposite edges of the saddle which are parallel to the longitudinal axis of the cylinder thereof, said structure being entirely contained in the region between said edges and including, in combination: an elongate base member constructed for securement to said press cylinder; an elongate locking bar aligned with, disposed over, and slideably engaging said base member and constructed for translational movement transverse to its elongate dimension with respect to said base member, said elongate locking bar having securement means for releasably retentively engaging said printing plate, said base member and said locking bar being provided with first, mutually cooperable, releasable detent means mutually engaged when said locking bar is moved in a first direction with respect to said base member to effect release of said printing plate; and spring means for slidably moving said locking bar in an opposite direction, to effect plate lock-up mounting, when said first detent means means are disengaged, said detent means and said spring means being wholly contained within said structure.

2. The combination of claim 1 wherein said base member has means for also releasably retaining a printing plate.

3. The combination of claim 1 wherein said securement means includes a plurality of tongue portions.

4. The combination of claim 1 wherein said base member includes an upstanding flange having a plurality of mutually spaced tab portions.

5. The combination of claim 1 wherein said base member includes an upstanding flange provided with laterally formed tab portions.

6. The combination of claim 1 wherein said detent means of said base member comprises upwardly angulated depressable finger means, said locking bar being provided with aperture means having reaction edges comprising said locking bar detent means.

7. The combination of claim 1 wherein said base member and locking bar having mutually intercooperable second detent means releasable in the opposite direction relative to said first detent means.

8. The combination of claim 1 wherein said base member and locking bar have mutually opposite, upstanding flanges, said spring means being operably disposed between said flanges.

9. The combination of claim 8 wherein said spring means comprise plural leaf springs.

10. Structure for releasably securing an edge of a printing plate to a press cylinder provided with a saddle having opposite edges parallel to the longitudinal axis of the cylinder said structure being wholly contained between said edges and including, in combination: an elongate base member constructed for securement to said press cylinder, said base member having normally inclined, manually depressable, resilient finger means operative, when disposed in the normally inclined position thereof, to engage an external abutment, an elongate transversely translatable locking bar longitudinally aligned with and slideably secured over said elongate base member and having means for releasably securing an external printing plate, said locking bar being provided with an externally accessible, finger-means access aperture and with an abutment proximate said aperture and aligned for engagement with and selectively engaging said finger means, and spring means for transversely urging said locking bar in a direction away from finger-means engagement with said abutment, said resilient finger means being wholly self-contained within said structure wherein depression of said finger means and disengagement of said finger means from said abutment causes said spring means to move said locking bar relative to said base member to secure a plate on the cylinder.

11. The combination of claim 10 wherein said locking bar is provided with aperture defining structure aligned with said finger means and having abutment edge defining structure comprising said abutment means.

12. In combination, a press cylinder provided with a saddle; a elongate base member transversely secured on said cylinder proximate said saddle; a elongate locking bar longitudinally aligned with and slideably secured for translational movement transverse to its direction of elongation over said base member and having printing plate engagement means, said base member and locking bar having cooperable, first mutually releasably engageable detent means for releasably securing said locking bar at a position over said base member to effect printing-plate-unlock by said locking-bar printing-plate engagement means, said detent means comprising resilient, upwardly angulated finger structure integral with said base member and cooperative abutment structure located proximate to a finger-structure external-access aperture in said locking bar and releasably cooperative with said finger structure, and spring means for urging said locking bar in a printing-plate-lock position, relative to said printing plate engagement means, when said detent means is manually released.

13. Structure according to claim 12 wherein said locking bar and base member have additional detent means releasable in an opposite direction to that of said first detent means.

* * * * *